US010208942B2

(12) United States Patent
Yagi

(10) Patent No.: US 10,208,942 B2
(45) Date of Patent: Feb. 19, 2019

(54) LIGHT SOURCE UNIT AND LAMP

(71) Applicant: KOITO MANUFACTURING CO., LTD., Tokyo (JP)

(72) Inventor: Takayuki Yagi, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 100 days.

(21) Appl. No.: 15/376,981

(22) Filed: Dec. 13, 2016

(65) Prior Publication Data

US 2017/0167689 A1 Jun. 15, 2017

(30) Foreign Application Priority Data

Dec. 14, 2015 (JP) ..... 2015-243105

(51) Int. Cl.
*F21V 29/67* (2015.01)
*F21V 29/71* (2015.01)
(Continued)

(52) U.S. Cl.
CPC ..... *F21V 29/677* (2015.01); *F21S 41/192* (2018.01); *F21S 41/27* (2018.01); *F21S 41/331* (2018.01);
(Continued)

(58) Field of Classification Search
CPC ..... F21S 48/321; F21S 48/142; F21S 41/47; F21S 41/338; F21S 41/27; F21S 45/43;
(Continued)

(56) References Cited

U.S. PATENT DOCUMENTS 4,967,329 A * 10/1990 Tatavoosian ..... F21V 15/04 362/240
2005/0173708 A1 8/2005 Suehiro et al.
(Continued)

FOREIGN PATENT DOCUMENTS

CN 102399443 A 4/2012
CN 102713430 A 10/2012
(Continued)

OTHER PUBLICATIONS

Office Action issued in Chinese Application No. 201611141188.7, dated Dec. 10, 2018 (18 pages).

*Primary Examiner* — Laura Tso
(74) *Attorney, Agent, or Firm* — Osha Liang LLP

(57) ABSTRACT

A light source unit includes a heat-dissipation member having positive expansibility that volume is expanded with an increase in temperature, the heat-dissipation member having a through-hole, a heating component having a heating component body and a pin terminal, the heating component body fixed to the heat-dissipation member in one opening side of the through-hole, the pin terminal connected to the heating component body, and inserted through the through hole and protruding from the other opening side of the through-hole of the heat-dissipation member a substrate fixed to the heat-dissipation member in the other opening side of the through-hole and having a wiring connected to the pin terminal, and a buffering member having negative thermal-expansibility that volume is contracted with an increase in temperature.

6 Claims, 2 Drawing Sheets

(51) Int. Cl.

| | |
|---|---|
| ***F21V 29/76*** | (2015.01) |
| ***F21S 41/19*** | (2018.01) |
| ***F21S 41/27*** | (2018.01) |
| ***F21S 41/33*** | (2018.01) |
| ***F21S 45/49*** | (2018.01) |
| ***F21S 45/43*** | (2018.01) |
| *F21Y 115/30* | (2016.01) |
| *F21S 41/29* | (2018.01) |
| *F21S 41/47* | (2018.01) |

(52) U.S. Cl.
CPC ..... *F21S 45/43* (2018.01); *F21S 45/49* (2018.01); *F21V 29/713* (2015.01); *F21V 29/763* (2015.01); *F21S 41/295* (2018.01); *F21S 41/338* (2018.01); *F21S 41/47* (2018.01); *F21Y 2115/30* (2016.08)

(58) Field of Classification Search
CPC ..... F21S 45/49; F21S 41/192; F21S 41/331; F21V 29/667; F21V 29/713; F21V 29/763; F21Y 2115/30
USPC ..... 362/547
See application file for complete search history.

(56) References Cited

U.S. PATENT DOCUMENTS

| | | | | |
|---|---|---|---|---|
| 2011/0273876 | A1* | 11/2011 | Stolyar | F21V 17/101 362/235 |
| 2012/0008316 | A1* | 1/2012 | Ivey | F21V 19/003 362/217.13 |
| 2012/0037842 | A1 | 2/2012 | Kubota et al. | |
| 2012/0287602 | A1* | 11/2012 | Urano | F21S 4/20 362/84 |
| 2013/0038841 | A1 | 2/2013 | Zakoji et al. | |
| 2014/0134038 | A1 | 5/2014 | Kubota et al. | |
| 2015/0316710 | A1 | 11/2015 | Liu | |

FOREIGN PATENT DOCUMENTS

| | | | |
|---|---|---|---|
| CN | 103982868 | A | 8/2014 |
| CN | 104360572 | A | 2/2015 |
| JP | 2006-278361 | A | 10/2006 |

* cited by examiner

LIGHT SOURCE UNIT AND LAMP

CROSS-REFERENCE TO RELATED APPLICATION

The present application claims priority from Japanese Patent Application No. 2015-243105 filed on Dec. 14, 2015, the entire content of which is incorporated herein by reference.

BACKGROUND

Technical Field

The present invention relates to a light source unit and a lamp using the same.

Related Art

As a lamp, for example, a lamp has been known that uses a light source unit with a structure in which a semiconductor laser package that is a light emitting component is placed on a substrate via a metallic heat-dissipation member (see Patent Document 1 below).

The semiconductor laser package disclosed in the following Patent Document 1 has a stem that is a base. The stem is fixed by being press-fitted into a hole of the metallic heat-dissipation plate disposed on one surface of a circuit substrate. A laser element is mounted on the stem and a tubular cap is provided on the stem so as to surround the laser element. A rod-shaped lead terminal is connected to the laser element. The lead terminal is inserted into a hole penetrating in a thickness direction of the circuit substrate, thereby being fixed to a circuit pattern of the circuit substrate.

Patent Document 1: Japanese Patent Laid-Open Publication No. 2006-278361

By the way, in the light source unit disclosed in the Patent Document 1, the stem positioned on one end side of the semiconductor laser package is fixed to the heat-dissipation plate and the lead terminal positioned on the other end side of the semiconductor laser package is fixed to the substrate. Therefore, for example, when the heat-dissipation plate is expanded due to a change in temperature, or the like, a pulling force in a longitudinal direction of the lead terminal tends to be applied to the lead terminal of the semiconductor laser package. When this pulling force is applied to the lead terminal, there is a concern that current-carrying failure occurs between the lead terminal and the circuit pattern of the circuit substrate.

SUMMARY

Exemplary embodiments of the invention provide a light source unit capable of reducing current-carrying failure and a lamp using the same.

A light source unit according to an exemplary embodiment comprises:

a heat-dissipation member having positive expansibility that volume is expanded with an increase in temperature, the heat-dissipation member having a through-hole;

a heating component having a heating component body and a pin terminal, the heating component body fixed to the heat-dissipation member in one opening side of the through-hole, the pin terminal connected to the heating component body, and inserted through the through hole and protruding from the other opening side of the through-hole of the heat-dissipation member;

a substrate fixed to the heat-dissipation member in the other opening side of the through-hole and having a wiring connected to the pin terminal; and a buffering member having negative thermal-expansibility that volume is contracted with an increase in temperature.

The buffering member is provided for alleviating a force to be applied to the pin terminal in accordance with the expansion of the heat-dissipation member.

In this light source unit, the heating component body of the heating component is fixed to one opening side of the through-hole of the heat-dissipation member having positive expansibility that volume is expanded with an increase in temperature, and the substrate is disposed on the other opening side of the through-hole thereof. Further, the pin terminal of the heating component is fixed to the wiring of the substrate through the through-hole of the heat-dissipation member. Therefore, the heat-dissipation member is often expanded due to the heat of the heating component body.

Meanwhile, in the light source unit of the present invention, the buffering member is provided so that a force to be applied to the pin terminal in accordance with the expansion of the heat-dissipation member is buffered. The buffering member has negative thermal-expansibility that volume is contracted with an increase in temperature. Therefore, even when the heat-dissipation member is expanded due to the heat of the heating component body, the buffering member serves to buffer the expansion of the heat-dissipation member.

Therefore, in the light source unit of the present invention, a pulling force which occurs in the pin terminal in a longitudinal direction of the pin terminal in accordance with the expansion of the heat-dissipation member is weakened, as compared to the case where the buffering member is omitted. As a result, the occurrence of current-carrying failure between the pin terminal and the wiring of the substrate is reduced.

The buffering member may be a plate shape and may be disposed between the heat-dissipation member and the substrate. The buffering member may have a particulate form and is dispersed in the heat-dissipation member or the substrate.

According to the present invention as described above, it is possible to provide a light source unit capable of reducing current-carrying failure and a lamp using the same.

DETAILED DESCRIPTION

Hereinafter, embodiments for carrying out a light source unit according to the present invention and a lamp using the same are illustrated in conjunction with the accompanying drawings. The embodiments illustrated below are intended to facilitate the understanding of the present invention and not to be construed as limiting the present invention. The present invention can be changed and enhanced without departing from the spirit thereof.

(1) First Embodiment

Figure 1:
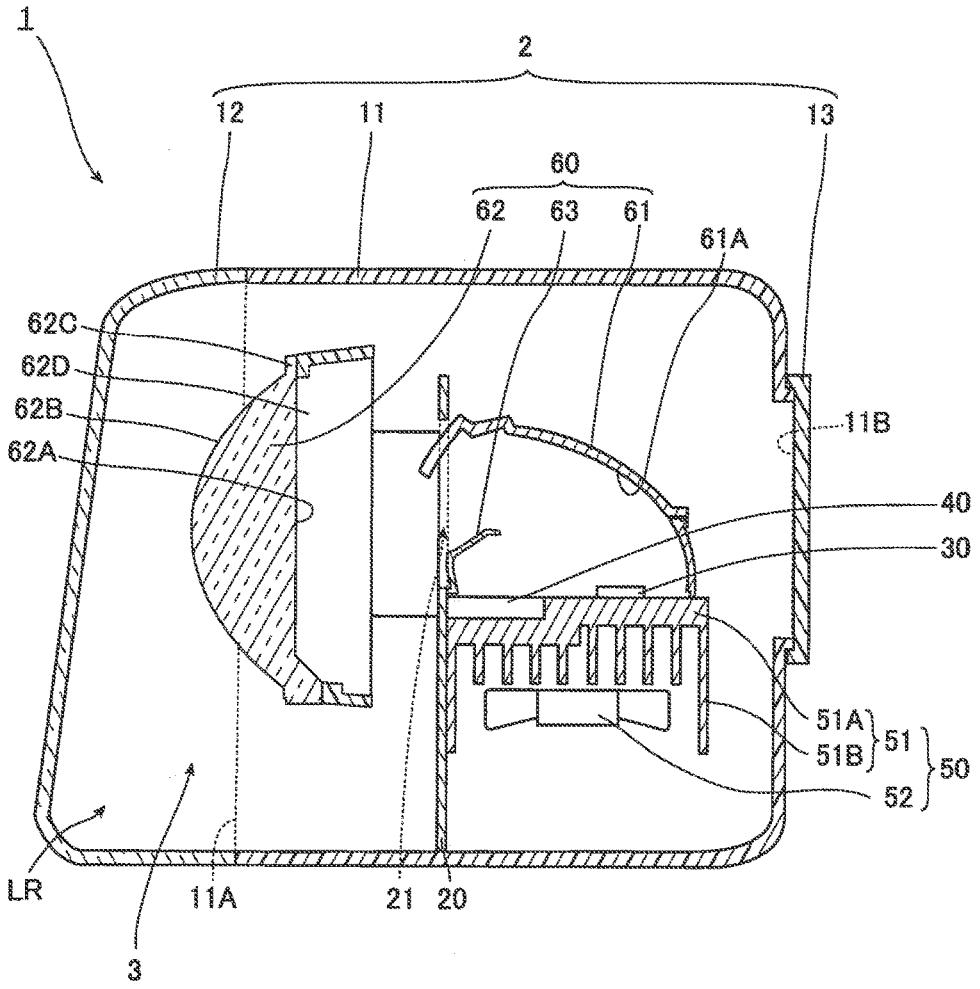
FIG. 1 is a sectional view schematically showing a lamp in a first embodiment.

FIG. 1 is a sectional view schematically showing a lamp in a first embodiment. As shown in FIG. 1, a lamp 1 of the present embodiment is a lamp to be used in a vehicle. The lamp 1 is a vehicle headlamp disposed in a vehicle front. The lamp 1 includes a housing 2 and a lamp unit 3 accommodated in the housing.

<Housing 2>

The housing 2 includes, as main components, a lamp housing 11, a translucent cover 12 and a back cover 13. An opening 11A is formed on the front portion of the lamp housing 11. The translucent cover 12 that is transparent is fixed to the lamp housing 11 so as to close the opening 11A. Further, an opening 11B smaller than the front opening 11A is formed on the rear portion of the lamp housing 11. The back cover 13 is fixed to the lamp housing 11 so as to close the opening 11B.

A lamp chamber LR is configured by a space which is defined by the lamp housing 11, the translucent cover 12 closing the front opening 11A of the lamp housing 11 and the back cover 13 closing the rear opening 11B of the lamp housing 11. The lamp unit 3 is accommodated in the lamp chamber LR.

<Lamp Unit 3>

The lamp unit 3 includes, as main components, a base plate 20, a light source unit 30, a light control unit 40, a heat-dissipation unit 50, and an optical unit 60.

The base plate 20 is a plate-shaped metallic member and is fixed to the lamp housing 11 of the housing 2. The base plate 20 is provided with an opening 21 penetrating the base plate 20. The opening 21 is disposed on an optical path through which the light emitted from the light source unit 30 passes. In the case of the present embodiment, the opening 21 is provided substantially in parallel along an opening surface of the opening 11A provided on the front portion of the lamp housing 11.

The light source unit 30 is a unit that emits light for lighting in the lamp 1. The light control unit 40 is a unit that switches the on/of of power supply to the light source unit 30 and adjusts the brightness or light distribution pattern or the like of light emitted from the light source unit.

The heat-dissipation unit 50 is a unit that diffuses the heat generated in the light source unit 30. The heat-dissipation unit 50 of the present embodiment includes, as main components, a heat sink 51 and a cooling fan 52.

The heat sink 51 has a metallic base board 51A. A plurality of heat-dissipation fins 51B is provided, integrally with the base board 51A, on the one surface side of the base board 51A. The light source unit 30 and the light control unit 40 are disposed on the surface of the base board 51A opposite to the side on which the heat-dissipation fins 51B are provided. The light source unit 30 and the light control unit 40 are fixed to the base board 51A. The cooling fan 52 is arranged with a gap from the heat-dissipation fins 51B and fixed to the heat sink 51.

In the heat-dissipation unit 50 of the present embodiment, the heat generated from the light source unit 30 and the light control unit 40 is transferred to the heat-dissipation fins 51B from the base board 51A, and also, the heat-dissipation fins 51B are cooled by the cooling fan 52. Therefore, in the heat-dissipation unit 50 of the present embodiment, the heat of the light source unit 30 and the light control unit 40 is efficiently diffused.

The optical unit 60 is a unit that deals with the light emitted from the light source unit 30. The optical unit 60 of the present embodiment includes, as main components, a reflector 61, a projection lens 62, and a shade 63.

The reflector 61 is composed of a curved plate material. The reflector 61 is fixed to the base board 51A of the heat sink 51 so as to cover the light source unit 30. A surface of the reflector 61 facing the light source unit 30 becomes a reflective surface 61A. The reflective surface 61A is basically formed of a spheroidal curved surface. The light source unit 30 is arranged at or near a first focus position of a first focus and a second focus of the spheroidal curved surface. At least a portion of the light emitted from the light source unit 30 is reflected toward the projection lens 62 by the reflective surface 61A.

The projection lens 62 is a non-spherical plano-convex lens or a biconvex lens. In this projection lens 62, an incident surface 62A on the side on which the light emitted from the light source unit 30 is incident has a planar shape or a convex shape and an emitting surface 62B on the side from which the light is emitted has a convex shape bulging in an emitting direction. In the case of the present embodiment, the projection lens 62 is arranged such that a rear focus of the projection lens 62 is located at or near the second focus of the reflective surface 61A of the reflector 61. That is, a PES (Projector Ellipsoid System) optical system is employed in the lamp unit 3 of the present embodiment.

A flange 62C is formed at an outer periphery of the projection lens 62. The flange 62C is welded to one end of a lens holder 62D. An end portion of the lens holder 62D on the side opposite to the projection lens 62 side is fixed to the base plate 20 by a screwing or the like, so that the projection lens 62 is held.

The shade 63 is a member for blocking a portion of the light emitted from the light source unit 30. The shade 63 is fixed to the surface of the base plate 20 on the side opposite to the projection lens 62 side. A portion of the light emitted from the light source unit 30 and reflected by the reflector 61 is irradiated to the shade 63. A portion of this light is not incident on the projection lens 62 by being shielded by the shade 63, and other portion thereof is incident on the projection lens 62 by being reflected by the shade 63. In this manner, the light from the light source unit 30 is controlled by the shade 63 to be incident on the projection lens 62. As a result, the light emitted from the projection lens 62 is formed in a desired light-distribution pattern.

In the optical unit 60 of the present embodiment, as described above, the projection lens 62 is fixed to the base plate 20 via the lens holder 62D, and the shade 63 is fixed to the base plate 20. Therefore, a relative position between the projection lens 62 and the shade 63 is accurately determined. Further, in the optical unit 60 of the present embodiment, the reflector 61 and the light source unit 30 are also fixed to the base plate 20 via the heat-dissipation unit 50. Therefore, respective relative positions among the light source unit 30, the reflector 61, the shade 63 and the projection lens 62 are also accurately determined. Therefore, it is possible to accurately predict an optical path of light which is emitted from the light source unit 30 and is incident on the projection lens 62 via the shade 63. Meanwhile, in the present embodiment, an example where the shade 63 is fixed has been illustrated. However, for example, the shade 63 may be movable. In this case, it is possible to change the light distribution pattern by controlling the movement of the shade 63 by the light control unit 40.

<Light Source Unit 30>

Figure 2:
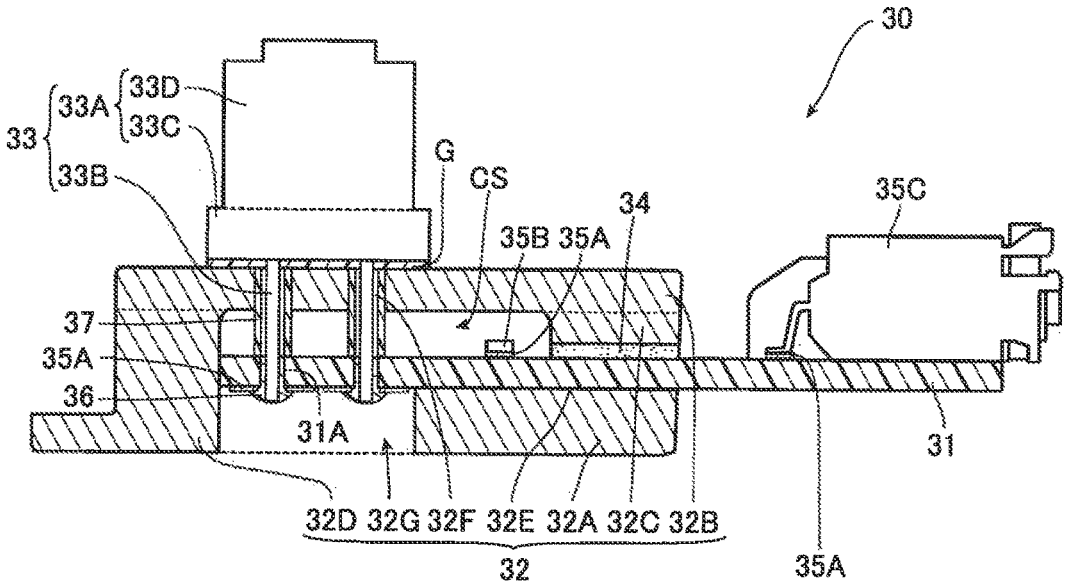
FIG. 2 is a sectional view schematically showing a light source unit in the first embodiment.

FIG. 2 is a sectional view schematically showing the light source unit 30 in the first embodiment. As shown in FIG. 2, the light source unit 30 of the present embodiment includes, as main components, a substrate 31, a heat-dissipation member 32, a light emitting component 33 and a buffering member 34.

The substrate 31 is, for example, an insulation board made of glass epoxy resin or the like. A wiring 35A with a predetermined pattern is provided in the substrate 31. Circuit elements such as a thermistor 35B and a connector 35C are provided in predetermined areas of the wiring 35A. Further, a through-hole 31A penetrating the substrate 31 along a thickness direction of the substrate 31 is provided in the substrate 31. Meanwhile, for the sake of convenience, the thermistor 35B and the connector 35C are not shown in the cross-section in FIG. 1.

The heat-dissipation member 32 is a member for diffusing the heat generated in the light emitting component 33 and has positive expansibility that volume is expanded with an increase in temperature. The heat-dissipation member 32 of the present embodiment is formed mainly by using a thermal-conductive material represented by a metal such as aluminum. The heat-dissipation member 32 mainly conducts the heat to the heat sink 51.

The heat-dissipation member 32 has a lower base portion 32A, an upper base portion 32B, a connecting portion 32C and a support portion 32D. The lower base portion 32A is a region on which a portion of the substrate 31 is disposed. The upper base portion 32B is a region on which a portion of the light emitting component 33 is disposed. The connecting portion 32C is a region for connecting the lower base portion 32A and the upper base portion 32B such that an internal space CS is provided between the lower base portion 32A and the upper base portion 32B. The support portion 32D is a region which is located on the opposite side of the arrangement position of the connecting portion 32C through the internal space CS and which supports the upper base portion 32B.

The connecting portion 32C is provided with an opening 32E through which the substrate 31 is inserted. A portion of the substrate 31 is placed on the lower base portion 32A via the opening 32E and accommodated in the internal space CS. In the region of the upper base portion 32B on which a portion of the light emitting component 33 is placed, a through-hole 32F penetrating the upper base portion 32B along the thickness direction of the upper base portion 32B is provided. In the region of the lower base portion 32A which corresponds to the lower side of the through-hole 32F of the upper base portion 32B, an opening portion 32G which communicates the internal space CS and the outside of the heat-dissipation member 32 with each other is formed.

The light emitting component 33 has a light emitting component body 33A and a pin terminal 33B connected to the light emitting component body 33A. In the present embodiment, the light emitting component 33 is a CAN package. Meanwhile, for the sake of convenience, the light emitting component 33 is not shown in the cross-section in FIG. 1.

The light emitting component body 33A has a stem 33C and a cap 33D and is disposed on one opening side of the through-hole 32F provided in the upper base portion 32B of the heat-dissipation member 32. The stem 33C is a metallic pedestal that is fixed to the surface of the upper base portion 32B of the heat-dissipation member 32 on the side opposite to the surface on the internal space CS side by an adhesive G. The cap 33D is a metallic box member that is provided on the surface of the stem 33C on the side opposite to the surface facing the upper base portion 32B. A light emitting element (not shown) is accommodated in an internal space which is formed by the stem 33C and the cap 33D. The light emitting element is, for example, a semiconductor laser element and the wavelength region of the light emitted from the semiconductor laser element is, for example, in the range of 380 nm to 470 nm. At least two of the pin terminal 33B as an anode and the pin terminal 33B as a cathode are connected to this light emitting element.

The pin terminal 33B is fixed to the stem 33C in the state of being insulated from the stem 33C. The pin terminal 33B is inserted through the through-hole 32F of the upper base portion 32B of the heat-dissipation member 32 and the through-hole 31A of the substrate 31 disposed in the internal space CS of the heat-dissipation member 32. A portion of the pin terminal 33B protruding from the surface of the substrate 31 on the side opposite to the surface facing the upper base portion 32B of the heat-dissipation member 32 and a portion of the wiring 35A provided in the substrate 31 are fixed to each other by a solder 36. Meanwhile, a tubular insulation member 37 is provided between the through-hole 32F of the heat-dissipation member 32 and the pin terminal 33B. The tubular insulation member 37 is fitted into the heat-dissipation member 32 in the state of being abutted against an inner peripheral surface of the through-hole 32F of the heat-dissipation member 32 and an outer peripheral surface of the pin terminal 33B. The tubular insulation member 37 protrudes from the through-hole 32F of the heat-dissipation member 32 and extends to the substrate 31. This insulation member 37 suppresses the pin terminal 33B as an anode and the pin terminal 33B as a cathode from being short-circuited with each other via the heat-dissipation member 32.

The buffering member 34 is a member that is provided so as to buffer a force to be applied to the pin terminal 33B of the light emitting component 33 in accordance with the expansion of the heat-dissipation member 32. The buffering member 34 of the present embodiment has a plate shape and is disposed between the heat-dissipation member 32 and the substrate 31.

Specifically, the buffering member 34 is stacked on the region of the substrate 31 placed on the lower base portion 32A, which is inserted through the opening 32E of the heat-dissipation member 32. Further, one surface of the buffering member 34 is abutted against the surface of the substrate and the other surface of the buffering member 34 is abutted against an inner peripheral surface of the opening 32F of the heat-dissipation member 32. Further, the buffering member 34 is interposed between the substrate 31 and the heat-dissipation member 32, thereby being fixed to the heat-dissipation member 32.

Further, the buffering member 34 has negative thermal-expansibility that volume is contracted with an increase in temperature. Material having negative thermal-expansibility includes, for example, $BiNi_{1-x}Fe_xO_3$ (Bismuth-nickel-iron oxide) or $SrCu_3Fe_4O_{12}$ (strontium-copper-iron oxide), or the like. The buffering member 34 is made using this material.

As described above, the light emitting component body 33A of the light emitting component 33 is fixed to one opening side of the through-hole 32F of the heat-dissipation member 32 having positive expansibility that volume is expanded with an increase in temperature, and the substrate 31 is fixed to the other opening side of the through-hole 32F thereof. Further, the pin terminal 33B of the light emitting component 33 is fixed to the wiring 35A of the substrate through the through-hole 32F of the heat-dissipation member 32. Therefore, the heat-dissipation member 32 is often expanded due to the heat of the light emitting component body 33A.

Meanwhile, in the lamp 1 of the present embodiment, the plate-shaped buffering member 34 is disposed between the substrate 31 and the heat-dissipation member 32 in the state of being abutted against the substrate 31 and the heat-dissipation member 32. Further, the buffering member 34 has negative thermal-expansibility that volume is contracted with an increase in temperature. Therefore, when the heat-dissipation member 32 is expanded due to the heat of the light emitting component body 33A, the buffering member 34 disposed between the heat-dissipation member 32 and the substrate 31 is contracted. As a result, an increase in distance between the light emitting component body 33A fixed to the heat-dissipation member 32 and the pin terminal 33B connected to the substrate 31 fixed to the heat-dissipation member 32 is reduced, and hence, a pulling force occurring in the pin terminal 33B in the longitudinal direction of the pin terminal 33B is reduced.

In this way, in the lamp 1 of the present embodiment, the buffering member 34 buffers the pulling force occurring in the pin terminal 33B in the longitudinal direction of the pin terminal 33B in accordance with the expansion of the heat-dissipation member 32. As a result, in the lamp 1 of the present embodiment, as compared to the case where the buffering member 34 is omitted, the occurrence of cracks or the like is reduced in the solder 36 to fix the pin terminal 33B and the wiring 35A of the substrate 31, and thus, the occurrence of current-carrying failure between the pin terminal 33B and the wiring 35A is reduced.

By the way, the $BiNi_{1-x}Fe_xO_3$ has a coefficient of linear expansion of −187 [ppm/·℃] and aluminum has a coefficient of linear expansion of 21.3 [ppm/·℃]. In the case where the buffering member 34 of the present embodiment is formed using the $BiNi_{1-x}Fe_xO_3$ and the heat-dissipation member 32 of the present embodiment is formed using aluminum, on the calculation basis, the buffering member 34 is contracted to resist against the expansion of the heat-dissipation member 32 when the thickness of the buffering member 34 is 1 [mm]. Therefore, the pulling force occurring in the pin terminal 33B in the longitudinal direction of the pin terminal 33B in accordance with the expansion of the heat-dissipation member 32 is suppressed by the buffering member 34.

Further, the $SrCu_3Fe_4O_{12}$ has a coefficient of linear expansion of −25 [ppm/·℃]. In the case where the buffering member 34 of the present embodiment is formed using the $SrCu_3Fe_4O_{12}$ and the heat-dissipation member 32 of the present embodiment is formed using aluminum, on the calculation basis, the buffering member 34 is contracted to resist against the expansion of the heat-dissipation member 32 when the thickness of the buffering member 34 is 1.73 [mm]. Therefore, the pulling force occurring in the pin terminal 33B in the longitudinal direction of the pin terminal 33B in accordance with the expansion of the heat-dissipation member 32 is generally suppressed by the buffering member 34.

Meanwhile, even when the thickness of the buffering member 34 is smaller than the thickness to resist against the expansion of the heat-dissipation member 32, the expansion of the heat-dissipation member 32 is buffered by the magnitude corresponding to the thickness of the buffering member 34 to be provided, as compared to the case where the buffering member 34 is omitted.

Second Embodiment

Out of the components in the light source unit 30 of the present embodiment, the same or similar components as those in the first embodiment are denoted by the same reference numerals as in the first embodiment and a duplicated description thereof is suitably omitted.

Figure 3:
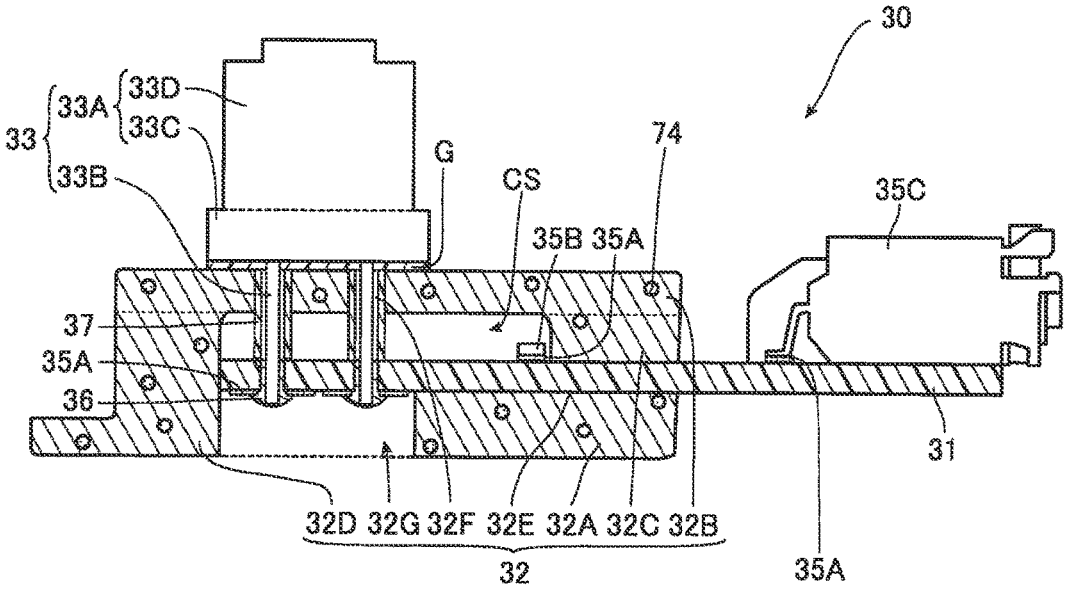
FIG. 3 is a sectional view schematically showing a light source unit in a second embodiment.

FIG. 3 is a sectional view schematically showing the light source unit 30 in the second embodiment. As shown in FIG. 3, in the light source unit 30 of the present embodiment, a buffering member 74 is employed, instead of the buffering member 34 of the first embodiment.

Specifically, the buffering member 34 of the first embodiment has a plate shape and is disposed between the heat-dissipation member 32 and the substrate 31. On the contrary, the buffering member 74 of the present embodiment has a particulate form and is dispersed in the heat-dissipation member 32.

Therefore, in the case where the heat-dissipation member 32 is expanded due to the heat of the light emitting component body 33A, the buffering member 74 dispersed in the heat-dissipation member 32 is contracted and the thermal expansion in the heat-dissipation member 32 is reduced. Thus, an increase in distance between the light emitting component body 33A fixed to the heat-dissipation member 32 and the pin terminal 33B connected to the substrate 31 fixed to the heat-dissipation member 32 is reduced, and hence, a pulling force occurring in the pin terminal 33B in the longitudinal direction of the pin terminal 33B is reduced.

In this way, in the lamp 1 of the present embodiment, the buffering member 74 buffers the pulling force occurring in the pin terminal 33B in the longitudinal direction of the pin terminal 33B in accordance with the expansion of the heat-dissipation member 32. As a result, in the present embodiment, similar to the above first embodiment, the occurrence of cracks or the like is reduced in the solder 36 to fix the pin terminal 33B and the wiring 35A of the substrate 31, and thus, the occurrence of current-carrying failure between the pin terminal 33B and the wiring 35A is reduced.

By the way, when the buffering member 74 of the present embodiment is formed using the $BiNi_{1-x}Fe_xO_3$ or $SrCu_3Fe_4O_{12}$ and the heat-dissipation member 32 is formed using aluminum, on the calculation basis, the buffering member 74 is contracted so as to resist against the expansion of the heat-dissipation member 32 just by dispersing a small amount of buffering member 74 in the heat-dissipation member 32. Therefore, the pulling force occurring in the pin terminal 33B in the longitudinal direction of the pin terminal 33B in accordance with the expansion of the heat-dissipation member 32 is generally suppressed by the buffering member 74.

Meanwhile, even when the amount of the buffering member 74 to be dispersed in the heat-dissipation member 32 is smaller than the amount to resist against the expansion of the heat-dissipation member 32, the expansion of the heat-dissipation member 32 is buffered by the magnitude corresponding to the amount of the buffering member 74 to be provided, as compared to the case where the buffering member 74 is omitted.

In the present embodiment, the particulate buffering member 74 is dispersed in the heat-dissipation member 32. However, this buffering member 74 may be dispersed in the substrate 31, instead of the heat-dissipation member 32, or may be dispersed in both the heat-dissipation member 32 and the substrate 31.

(First Modification)

In the first embodiment, the plate-shaped buffering member 34 is disposed between the heat-dissipation member 32 and the substrate 31. Further, in the second embodiment, the particulate buffering member 74 is dispersed in the heat-dissipation member 32. However, the buffering member is not limited to the first embodiment or the second embodiment. For example, the tubular insulation member 37 in the first embodiment or the second embodiment may be used as the buffering member by using materials such as the $BiNi_{1-x}Fe_xO_3$ air $SrCu_3Fe_4O_{12}$.

As described above, the tubular insulation member 37 is fitted into the heat-dissipation member 32 in the state of being abutted against the inner peripheral surface of the through-hole 32F of the heat-dissipation member 32 and the outer peripheral surface of the pin terminal 33B. Therefore, in the case where the tubular insulation member 37 is used as the buffering member, the buffering member is contracted in the manner of grasping the pin terminal 33B when the heat-dissipation member is expanded due to the heat of the light emitting component body 33A. As a result, a force that is against a pulling force occurring in the pin terminal 33B in the longitudinal direction of the pin terminal 33B is directly applied to the pin terminal 33B.

Meanwhile, in the case where the tubular insulation member 37 is used as the buffering member in the first embodiment, the buffering member 34 may be omitted or may not be omitted. However, in the case where the buffering member 34 is not omitted, it is desirable that the negative thermal-expansibility in the tubular buffering member (insulation member 37) becomes greater than the negative thermal-expansibility in the plate-shaped buffering member 34.

Further, in the above embodiment, the heat-dissipation member 32 is formed separately from the heat sink 51. However, the heat-dissipation member 32 may be formed integrally with the heat sink 51.

Further, in the above embodiment, the light emitting component 33 including the light emitting component body 33A and the pin terminal 33B has been applied as the heating component. However, the heating component is not limited to the light emitting component 33, so long as the heating component includes a heating component body and a pin terminal connected to the heating component body.

Further, in the above embodiment, a portion of the pin terminal 33B and a portion of the wiring 35A are fixed to each other by the solder 36 serving as the connecting member for connecting these portions. However, the connecting member is not limited to the solder 36, so long as the connecting member can electrically and mechanically connect a portion of the pin terminal 33B and a portion of the wiring 35A by filling a space therebetween.

Further, in the above embodiment, the vehicle headlamp has been applied as an example of the lamp. However, the lamp is not limited to the above embodiments. For the lamp used in the vehicle, an indication lamp such as a tail lamp may be applied or an interior illumination may be applied. Further, although the PES optical system has been applied as the optical unit 60, a parabola optical system may be applied or a mono-focus optical system may be applied. Further, the lamp of the present invention may be a lamp which is used in applications other than vehicles.

According to the present invention, a light source unit capable of reducing the current-carrying failure and a lamp using the same are provided. The present invention can be utilized in the field of a vehicle lamp or the like.

What is claimed is:

1. A light source unit comprising:

a heat-dissipation member having positive expansibility that volume is expanded with an increase in temperature, the heat-dissipation member having a through-hole;

a heating component having a heating component body and a pin terminal, the heating component body fixed to the heat-dissipation member in one opening side of the through-hole, the pin terminal connected to the heating component body, and inserted through the through hole and protruding from the other opening side of the through-hole of the heat-dissipation member;

a substrate fixed to the heat-dissipation member in the other opening side of the through-hole and having a wiring connected to the pin terminal; and a buffering member having negative thermal-expansibility that volume is contracted with an increase in temperature, wherein the buffering member is structured to alleviate a force applied to the pin terminal in accordance with expansion of the heat-dissipation member.

2. The light source unit according to claim 1, wherein the buffering member has a plate shape and is disposed between the heat-dissipation member and the substrate.

3. The light source unit according to claim 1, wherein the buffering member has a particulate form and is dispersed in the heat-dissipation member or the substrate.

4. The light source unit according to claim 1, further comprising:

an insulation member fitted into the heat-dissipation member and abutted against an inner peripheral surface of the through-hole and an outer peripheral surface of the pin terminal.

5. A lamp comprising:

the light source unit according to claim 1.

6. The lamp according to claim 5, wherein the light source unit is used in a vehicle.

* * * * *